US005732366A

United States Patent [19]

Haas

[11] Patent Number: 5,732,366

[45] Date of Patent: Mar. 24, 1998

[54] METHOD OF REPROCESSING METAL PARTS RADIOACTIVELY CONTAMINATED WITH URANIUM

[75] Inventor: Ernst Haas, Buckenhof, Germany

[73] Assignee: Siemens Aktiengesellschaft, Munich, Germany

[21] Appl. No.: 794,567

[22] Filed: Feb. 3, 1997

Related U.S. Application Data

[60] Continuation of PCT/DE95/00964, Jul. 21, 1995.

[30] Foreign Application Priority Data

Aug. 1, 1994 [DE] Germany ..... 44 27 179.4

[51] Int. Cl.[6] ..... C21F 9/00

[52] U.S. Cl. ..... 588/11; 75/10.46; 75/10.5; 75/10.54; 75/10.62; 423/5; 588/14

[58] Field of Search ..... 588/11, 14; 75/393, 75/398, 10.46, 10.54, 10.62, 10.63, 10.5; 423/5

[56] References Cited

U.S. PATENT DOCUMENTS 5,348,567 9/1994 Chappell ..... 75/10.66

OTHER PUBLICATIONS

European Patent Abstract No. 2709816 (Uda et al.), Nuclear Technology, Apr. 1986, vol. 73, pp. 109–115.

European Patent Abstract No. 2596010 (Abe et al.), Conf. Waste Management 1985, Tuscon AZ, vol. 3, pp. 375–379.

European Patent Abstract No. 2118676 (Williams et al.), Conf. American Nuclear Society, Richland, WA, Apr. 19–22, 1982, pp. 115–118.

Japanese Patent Abstract No. 61045999 A, Mar. 6, 1986.

"Formation and Properties of Uranium Glasses (Chakrabarty), Ontario Research Foundation", Ceramic Bulletin, May 14, 1969, pp. 1076–1078.

"A Business and Market Assessment of Waste Treatment Technologies" (Ayen), JOM, May 1994, pp. 30–34.

"Recycling of Metallic Materials from the Dismantling of Nuclear Plants" (Sappok), Kerntechnik 56, 1991, No. 6, pp. 376–378.

"Melting makes the most of scrap metals", Nuclear Engineering 1994, vol. 476, pp. 51–52.

*Primary Examiner*—Ngoclan Mai

*Attorney, Agent, or Firm*—Herbert L. Lerner; Laurence A. Greenberg

[57] ABSTRACT

A method for reprocessing metal parts that are radioactively contaminated with uranium includes smelting the metal parts so that a melt and a slag are formed. $U_{235}$-depleted uranium is admixed with the metal parts and/or the melt and/or the slag. It is contemplated for the $U_{235}$-depleted uranium to be admixed in the form of uranium glass.

6 Claims, No Drawings

METHOD OF REPROCESSING METAL PARTS RADIOACTIVELY CONTAMINATED WITH URANIUM

CROSS-REFERENCE TO RELATED APPLICATION

This application is a Continuation of International Application Serial No. PCT/DE95/00964, filed Jul. 21, 1995.

BACKGROUND OF THE INVENTION

Field of the Invention

The invention relates to a method for reprocessing metal parts that are radioactively contaminated with uranium, wherein the metal parts are smelted to form a melt and a slag, and $U_{235}$-depleted uranium is admixed with the metal parts and/or the melt and/or the still-unsolidified slag.

During dismantling as well as during operation of nuclear plants, large amounts of contaminated metal scrap are produced, which must be eliminated or reprocessed. It is customary to subject the scrap to so-called smelting decontamination, in which the metal is smelted. Some radioactive substances that cause the decontamination and which were located on the surface of the metal parts before smelting, are incorporated into the slag formed during the smelting decontamination process. The melt that also forms, which has a volume that is markedly greater than the volume of the slag, remains largely free of radioactive substances.

As a rule, the slag must be classified as radioactive waste containing nuclear fuel, the handling and disposal of which require particular safety precautions. If the contamination was caused by uranium nuclear fuel, which contains 3.1% $U_{235}$, for instance, then smelting decontamination can be employed only to a limited extent if more than about 3 g of $U_{235}$ per hundred kg of slag can be expected. As a rule, that limit value is exceeded, unless additional precautions are taken, since in the smelting process the uranium moves into the slag and becomes concentrated there.

Exceeding the limit value could be avoided by admixing some other slag that contains no uranium with the slag that does contain uranium. The uranium concentration could be decreased to the necessary extent with a large enough amount of uranium-free slag. However, so much slag would be required that the total amount of slag would be increased to an uneconomical extent. Markedly more slag than before would have to be reprocessed.

A method has also already been proposed that contemplates renaturing of the uranium that causes the contamination. It happens that the isotope composition of the uranium which is to be incorporated into the slag or is already incorporated in the slag is altered in such a way as to correspond to the isotope composition of the natural uranium. That means that the proportion of $U_{235}$ must be no greater than about 0.7%. Uranium that is equivalent in its isotope composition to natural uranium does not have to be subjected to the safety regulations which apply to uranium nuclear fuel.

It is already known that to reduce the proportion of $U_{235}$ isotope, $U_{235}$-depleted uranium is admixed with the metal parts, the melt and/or the still-unsolidified slag. As a result, once the method is performed, a slag is obtained that incorporates uranium having a proportion of $U_{235}$ isotope which is equivalent to the proportion of $U_{235}$ isotope of natural uranium, or even below it.

It was heretofore customary to admix the $U_{235}$-depleted uranium in the form of $UO_2$ or $U_3O_8$. Those oxides are in powder form. Experience has shown that such a powder does not distribute uniformly in the melt or the slag. Consequently, it can happen that a slag sample may not have the desired low proportion of $U_{235}$ isotope. When the powder is admixed, dust gets into the ambient air. The dust must then be removed by filters in order to protect the workers.

SUMMARY OF THE INVENTION

It is accordingly an object of the invention to provide a method of reprocessing metal parts radioactively contaminated with uranium, which overcomes the hereinaforementioned disadvantages of the heretofore-known methods of this general type and with which reliable, complete renaturing of the uranium is possible so that it is then simple to handle and dispose of resultant slag.

With the foregoing and other objects in view there is provided, in accordance with the invention, a method for reprocessing metal parts radioactively contaminated with uranium, which comprises smelting metal parts to form a melt and a slag; and admixing $U_{235}$-depleted uranium in the form of uranium glass with the metal parts and/or the melt and/or the still-unsolidified slag.

The advantage which is thus attained is that during the smelting decontamination process, the $U_{235}$-depleted uranium can be mixed homogeneously with the uranium that has caused the contamination. The same advantage is attained if the uranium glass, which contains the $U_{235}$-depleted uranium, is admixed with the still-untreated metal scrap and/or with the melt and/or the still-liquid slag, if the slag has already been separated from the remainder of the melt.

The advantage which is attained through the use of the homogeneous mixing and incorporation of the uranium from the uranium glass, is that the isotope composition of the uranium in the slag is likewise homogeneous. There can be no individual zones in the slag that have an overly high $U_{235}$ concentration. Consequently, there is no need for all of the slag to be handled like fuel that contains nuclear waste, since the proportion of uranium in the slag, in terms of the isotope composition of the uranium, corresponds to the natural uranium. The slag can advantageously be handled and disposed of in a simple way.

In accordance with another mode of the invention, the $U_{235}$-depleted uranium is admixed, for instance in the form of uranium glass granules, uranium glass beads, uranium glass rods, and/or uranium glass pieces. Such parts of uranium glass can be produced by known methods and kept on hand.

In accordance with a further mode of the invention, a uranium glass that melts at low temperature is admixed. It happens that the uranium glass is a glass of low viscosity at the melting temperature of the metal of the metal parts. This has the advantage of ensuring that an improved liquefication of slag is attained solely through the use of the glass, regardless of its proportion of uranium. This then leads to even better homogeneous distribution of the admixed uranium.

In accordance with an added mode of the invention, uranium glass of the alkali oxide/$SiO_2$/$UO_2$ type is admixed. Such a glass may contain 50% uranium. The alkali oxide may be $Na_2O$, for instance.

In accordance with an additional mode of the invention, uranium glass whose uranium has a proportion of $U_{235}$ isotope below 0.7%, for example approximately 0.2%, is admixed. Given an adequate addition, one entertains a proportion of $U_{235}$ isotope in the slag which is advantageously so low that the slag can be disposed of without problems. If the proportion of $U_{235}$ isotope of the uranium that has caused the contamination should amount to 3.1%, for example, then with uranium glass whose proportion of $U_{235}$ isotope is 0.2%, a proportion of $U_{235}$ isotope in the slag that is less than 0.7% is attained.

In accordance with a concomitant feature of the invention, uranium glass that contains less than 50% uranium is admixed. In particular, the uranium glass contains less than 40% uranium, for instance between 5% and 15%. The density of a uranium glass is lower if the proportion of uranium in the glass is lower. If the proportion of uranium in the uranium glass is markedly lower than 50%, a uranium-containing slag is formed having a density which is markedly lower than the density of the iron-containing melt. As a result, the slag floats on the melt and can be separated especially easily from the melt, for example by being ladled off. The density of uranium glass having a uranium proportion of 10%, for instance, is 3.5 g/cm$^3$. The density of the uranium glass is 7.7 g/cm$^3$ for a uranium proportion of 50%. The density of iron is about 7.8 g/cm$^3$.

Other features which are considered as characteristic for the invention are set forth in the appended claims.

Although the invention is illustrated and described herein as embodied in a method of reprocessing metal parts radioactively contaminated with uranium, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the following examples.

DESCRIPTION OF THE PREFERRED EMBODIMENTS

It will be explained below in terms of an example how much uranium glass is needed for the method of the invention:

In smelting decontamination of contaminated metal parts, 55.4 kg of slag have been formed, which contain 69.25 g of $U_{238}$ and 2.21 g of $U_{235}$. This corresponds to a proportion of $U_{235}$ isotope of 3.09%. The proportion of $U_{235}$ isotope of 3.09% is to be lowered to 0.5% for renaturing. This proportion is below the proportion of $U_{235}$ isotope of natural uranium. In order to attain the desired lowering, $U_{235}$-depleted or downgraded uranium is used. The proportion of $U_{235}$ isotope of this depleted uranium is 0.2%, for instance. Of this depleted uranium, 620 g are required in order to obtain a slag having a proportion of $U_{235}$ isotope of 0.5%.

In the method of the invention, the depleted uranium is admixed in the form of uranium glass. By way of example, this uranium glass contains 10% uranium, having a proportion of $U_{235}$ isotope that is 0.2%. Then, advantageously, only 6.2 kg of glass are needed so as to lower the proportion of $U_{235}$ isotope from 55.4 kg of slag enough to ensure that the slag is easy to handle and can be stored and disposed of simply.

The advantage which is attained in particular with the method of the invention, is that it is easy to dispose of the slag, which contains uranium, occurring in smelting decontamination. Exposure to workers and the burden of uranium dust in dust filters are largely averted.

I claim:

1. A method for reprocessing metal parts radioactively contaminated with uranium, which comprises:

smelting metal parts to form a melt and a slag; and admixing $U_{235}$-depleted uranium in the form of uranium glass with at least one of the metal parts, the melt and the still-unsolidified slag.

2. The method according to claim 1, which comprises carrying out the admixing step by admixing the uranium glass in the form of at least one of granules, beads, rods and pieces.

3. The method according to claim 1, which comprises carrying out the admixing step by admixing the uranium glass in the form of a glass of low viscosity at the melting temperature of metal of the metal parts.

4. The method according to claim 1, which comprises carrying out the admixing step by admixing the uranium glass in the form of a glass of an alkali oxide/$SiO_2$/$UO_2$ type.

5. The method according to claim 1, which comprises carrying out the admixing step by admixing a uranium glass having uranium with a $U_{235}$ isotope proportion below 0.7%.

6. The method according to claim 1, which comprises carrying out the admixing step by admixing a uranium glass having a uranium proportion less than 50%.

* * * * *